US006296074B1

(12) United States Patent
Ridlen

(10) Patent No.: US 6,296,074 B1
(45) Date of Patent: Oct. 2, 2001

(54) NOISE REDUCING EXHAUST SYSTEM AND METHOD

(76) Inventor: Charles W. Ridlen, 1261 Bon Air Ct., Decatur, IL (US) 62521-3507

( * ) Notice: Subject to any disclaimer, the term of this patent is extended or adjusted under 35 U.S.C. 154(b) by 0 days.

(21) Appl. No.: 09/439,392

(22) Filed: Nov. 15, 1999

Related U.S. Application Data

(60) Provisional application No. 60/109,010, filed on Nov. 19, 1998.

(51) Int. Cl.[7] ..... F01N 7/00

(52) U.S. Cl. ..... 181/272; 181/273; 181/275; 181/282

(58) Field of Search ..... 181/238, 239, 181/240, 255, 257, 265, 266, 267, 268, 269, 272, 273, 275, 276, 282

(56) References Cited

U.S. PATENT DOCUMENTS

| | | | | |
|---|---|---|---|---|
| 702,031 | * | 6/1902 | Ronan | 181/238 |
| 2,484,827 | | 10/1949 | Harley . | |
| 2,853,148 | * | 9/1958 | Billey | 181/265 |
| 3,009,530 | * | 11/1961 | Cocklin | 181/265 |
| 3,948,349 | | 4/1976 | Bychinsky . | |
| 4,044,203 | | 8/1977 | Swinbanks . | |
| 4,108,276 | | 8/1978 | Hall et al. . | |
| 4,185,715 | | 1/1980 | Reu Boiu . | |
| 4,220,219 | | 9/1980 | Flugger . | |
| 4,424,882 | | 1/1984 | Moller . | |
| 4,467,887 | | 8/1984 | Vizard . | |
| 4,623,035 | | 11/1986 | Schad et al. . | |
| 4,809,812 | | 3/1989 | Flugger . | |
| 4,937,872 | | 6/1990 | Hopfield et al. . | |
| 5,060,271 | | 10/1991 | Geddes . | |
| 5,173,577 | | 12/1992 | Clegg et al. . | |
| 5,220,137 | * | 6/1993 | Howerton et al. | 181/265 |
| 5,278,913 | | 1/1994 | Delfosse et al. . | |
| 5,304,749 | | 4/1994 | Crandell . | |
| 5,614,699 | | 3/1997 | Yashiro et al. . | |

* cited by examiner

*Primary Examiner*—Khanh Dang

(57) ABSTRACT

A time warp method of reducing noise in an exhaust stream includes the step of directing the exhaust stream into an inlet aperture of a sound cancellation chamber. The method also includes reflecting sound in the sound cancellation chamber toward the inlet aperture of the sound cancellation chamber. Another step of the method includes spreading the exhaust stream radially toward a periphery of the sound cancellation chamber. Yet another step of the method includes collecting exhaust from the periphery of the sound cancellation chamber in an outlet collector ring. Moreover, the method includes directing the exhaust collected from the periphery of the sound cancellation chamber substantially circumferentially about the sound cancellation chamber toward an outlet aperture of the outlet collector ring. Muffler devices for implementing the method are also disclosed.

26 Claims, 12 Drawing Sheets

NOISE REDUCING EXHAUST SYSTEM AND METHOD

PRIORITY CLAIM

This application claims benefit to priority based upon Ridlen U.S. Provisional Patent Application Serial No. 60/109,010, filed on Nov. 19, 1998, for a TIME WARP MUFFLER.

FIELD OF THE INVENTION

The present invention relates to exhaust mufflers, and more particularly to sound-attenuating mufflers for internal combustion engines and other sources of pulsating gas flow with substantial acoustic energy transport.

BACKGROUND OF THE INVENTION

Most mufflers employ various types of baffles in order to diffuse the sound by sending the sound in many different non-cohesive directions. Many other mufflers use packing materials in order to absorb the sound within the packing material. Both of these methods accomplish noise reduction by absorbing sound energy or redirecting the sound energy to cause interference that results in an equalization of sound pressure highs and lows.

The problem with baffles and packing materials is that the baffles and packing materials tend to impede the flow of exhaust from an internal combustion engine thus causing back pressure to be applied to the engine. The more back pressure exerting on the engine, the less efficient the engine performs. Accordingly, performance mufflers are currently available which have lower back pressure thus enabling better engine performance. However, the performance mufflers are often considerably louder than mufflers employing baffles and packing materials.

In an attempt to obtain a muffler with both low back pressure and noise levels, electronic mufflers have come to the forefront. Besides being more expensive than non-electronic mufflers to manufacture, the electrical systems of the electronic mufflers have proven to be unreliable due to the harsh environment in which mufflers operate.

Accordingly, a need exists for an economical method and apparatus of reducing noise in an exhaust stream while causing very low back pressure and achieving adequate noise levels.

SUMMARY OF THE INVENTION

The present invention addresses the above need, as well as others, with a method and apparatus of reducing noise in an exhaust stream. In accordance with one embodiment of the present invention, there is provided a method that includes the step of directing the exhaust stream into an inlet aperture of a sound cancellation chamber. The method also includes reflecting sound in the sound cancellation chamber toward the inlet aperture of the sound cancellation chamber. Another step of the method includes spreading the exhaust stream radially toward a periphery of the sound cancellation chamber. Yet another step of the method includes collecting exhaust from the periphery of the sound cancellation chamber in an outlet collector ring. Moreover, the method includes directing the exhaust collected from the periphery of the sound cancellation chamber substantially circumferentially about the sound cancellation chamber toward an outlet aperture of the outlet collector ring.

Pursuant to another embodiment of the present invention, there is provided a method of reducing noise in an exhaust stream. One step of the method includes the step of splitting the exhaust stream into a first exhaust stream and a second exhaust stream that are substantially equal. The first exhaust stream is directed into a sound cancellation chamber on a common counter-flow centerline in a first flow direction. The second exhaust stream is directed into the sound cancellation chamber on the common counter-flow centerline in a second flow direction that is opposite to the first flow direction, such that the second exhaust stream meets the first exhaust stream at a noise cancellation center point on the common-flow centerline inside the first sound cancellation chamber. The exhaust is collected and expelled from the sound cancellation chamber.

Pursuant to a further embodiment of the present invention, there is provided a muffler for reducing noise in an exhaust stream. The muffler includes a sound cancellation chamber, a dividing inlet, and an outlet collector ring. The sound cancellation chamber includes a first major surface with a first intake aperture, a first peripheral edge, and first reflector walls operable to direct sound toward the first intake aperture. The sound cancellation chamber further includes a second major surface with a second intake aperture, a second peripheral edge, and second reflector walls operable to direct sound toward the second intake aperture. The dividing inlet is operable to receive the exhaust stream and split the exhaust stream into a first exhaust stream and a second exhaust stream. To this end, the dividing inlet includes a first inlet channel operable to direct the first exhaust stream into the first intake aperture of the sound cancellation chamber, and a second inlet channel operable to direct the second exhaust stream into the second intake aperture of the sound cancellation chamber. The outlet collector ring of the muffler is coupled to the first peripheral edge and the second peripheral edge of the sound cancellation chamber such that the outlet collector ring is operable to receive and expel exhaust from the sound cancellation chamber.

It is an object of the present invention to provide an improved method and apparatus for reducing noise in an exhaust stream.

It is also an object of the present invention to provide a new and useful method and apparatus for reducing noise in an exhaust stream.

It is another object of the present invention to provide a method and apparatus for reducing noise in an exhaust stream which causes very low back pressure to be exerted against the exhaust stream flow.

It is yet another object of the present invention to provide a method and apparatus for reducing noise in an exhaust stream that requires no electrical devices for adequate performance.

It yet a further object of the present invention to provide a method and apparatus for reducing noise in an exhaust stream which requires no moving parts for adequate performance.

Another object of the present invention is to provide a method and apparatus for reducing noise in an exhaust stream which requires no packing materials or baffles for adequate performance.

The above and other objects, features, and advantages of the present invention will become apparent from the following description and the attached drawings.

DETAILED DESCRIPTION OF AN EXEMPLARY EMBODIMENT

Figure 1:
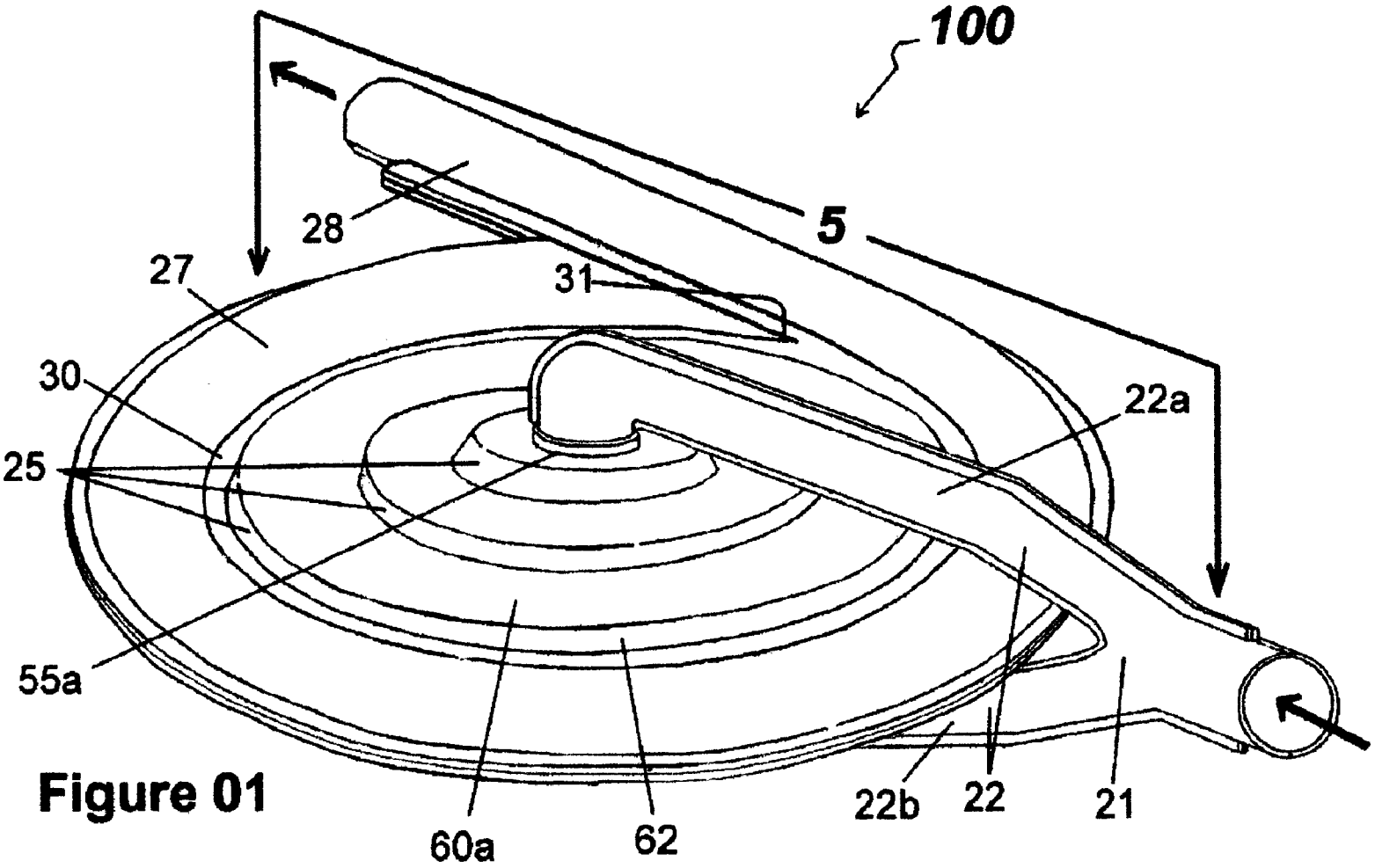
FIG. 1 shows a perspective view of a first exemplary muffler which incorporates various features of the present invention therein.
Figure 2:
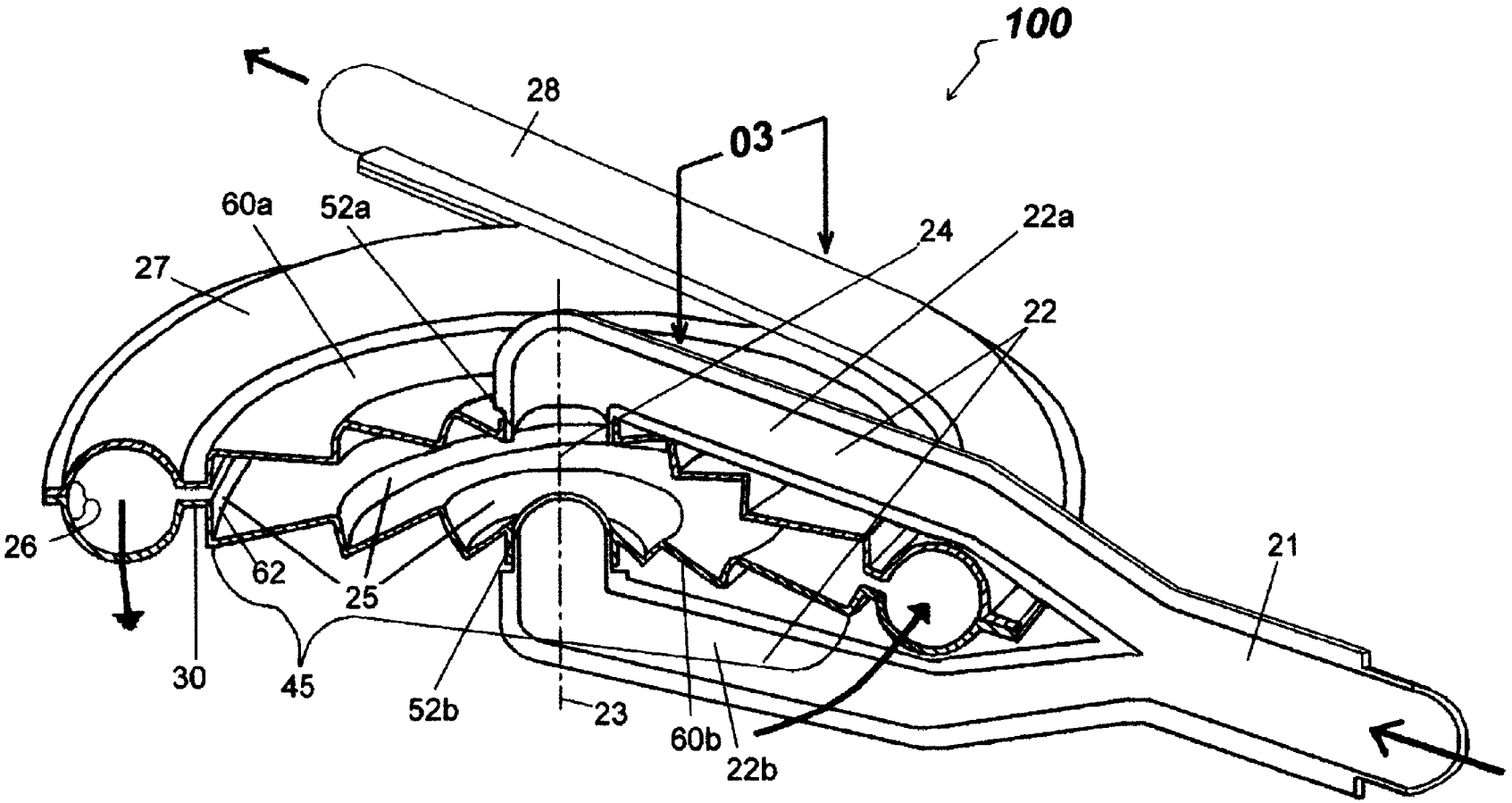
FIG. 2 shows a perspective cut-away view of the first exemplary muffler taken along reference line 5 of FIG. 1.
Figure 3:
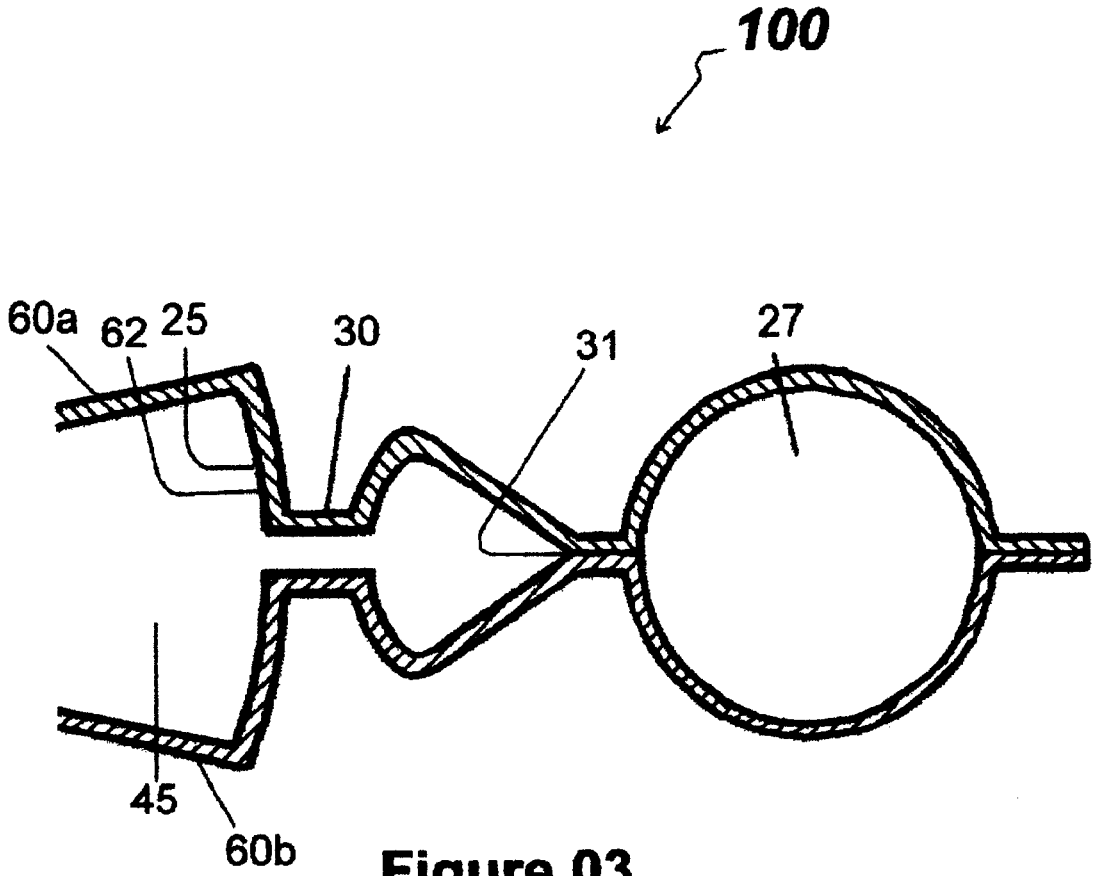
FIG. 3 shows a cross-sectional view of the first exemplary muffler taken along reference line 3 of FIG. 2.
Figure 4:
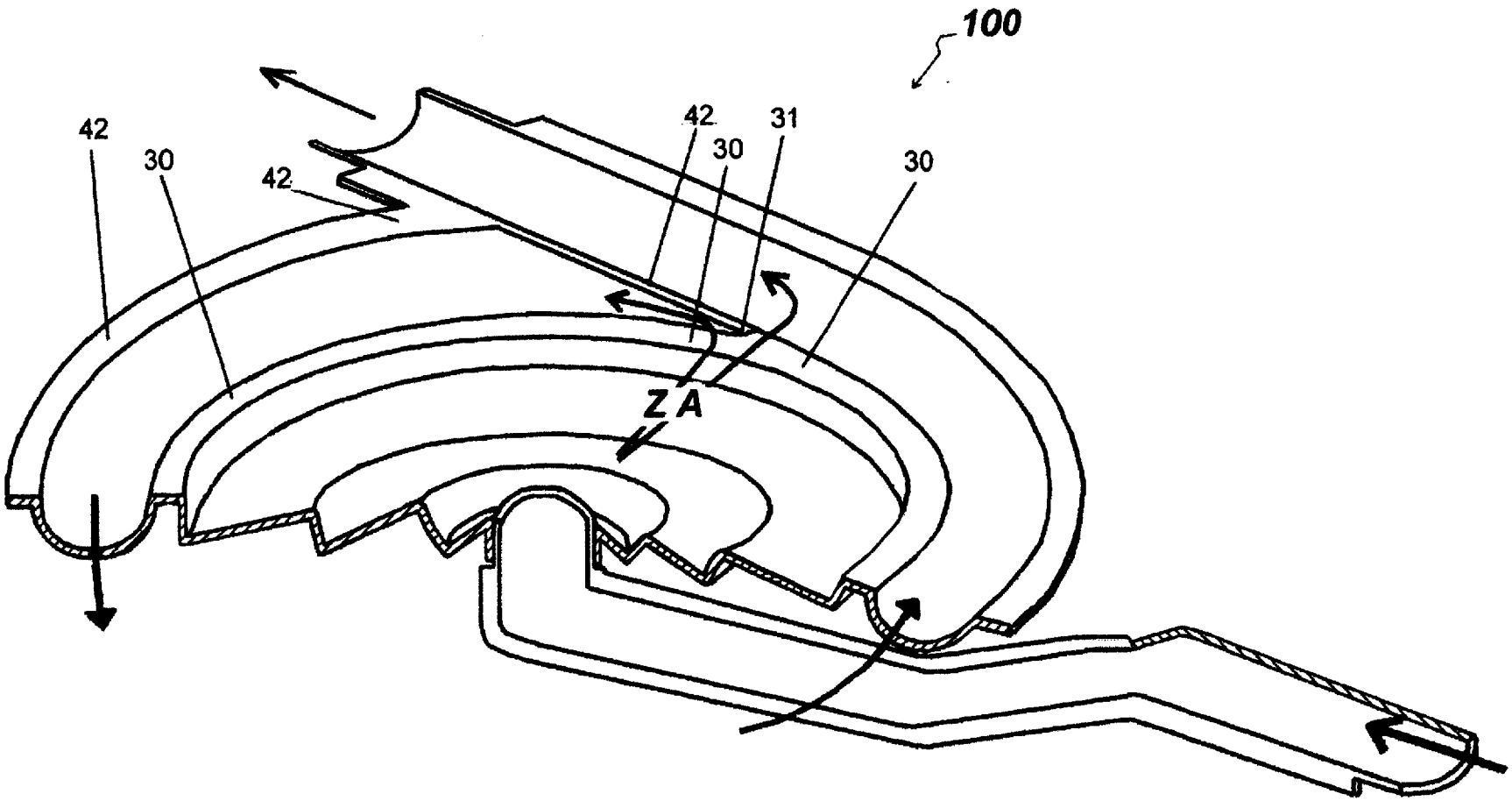
FIG. 4 shows a detailed view of the bottom half of the first exemplary muffler as depicted in FIG. 2.
Figure 5:
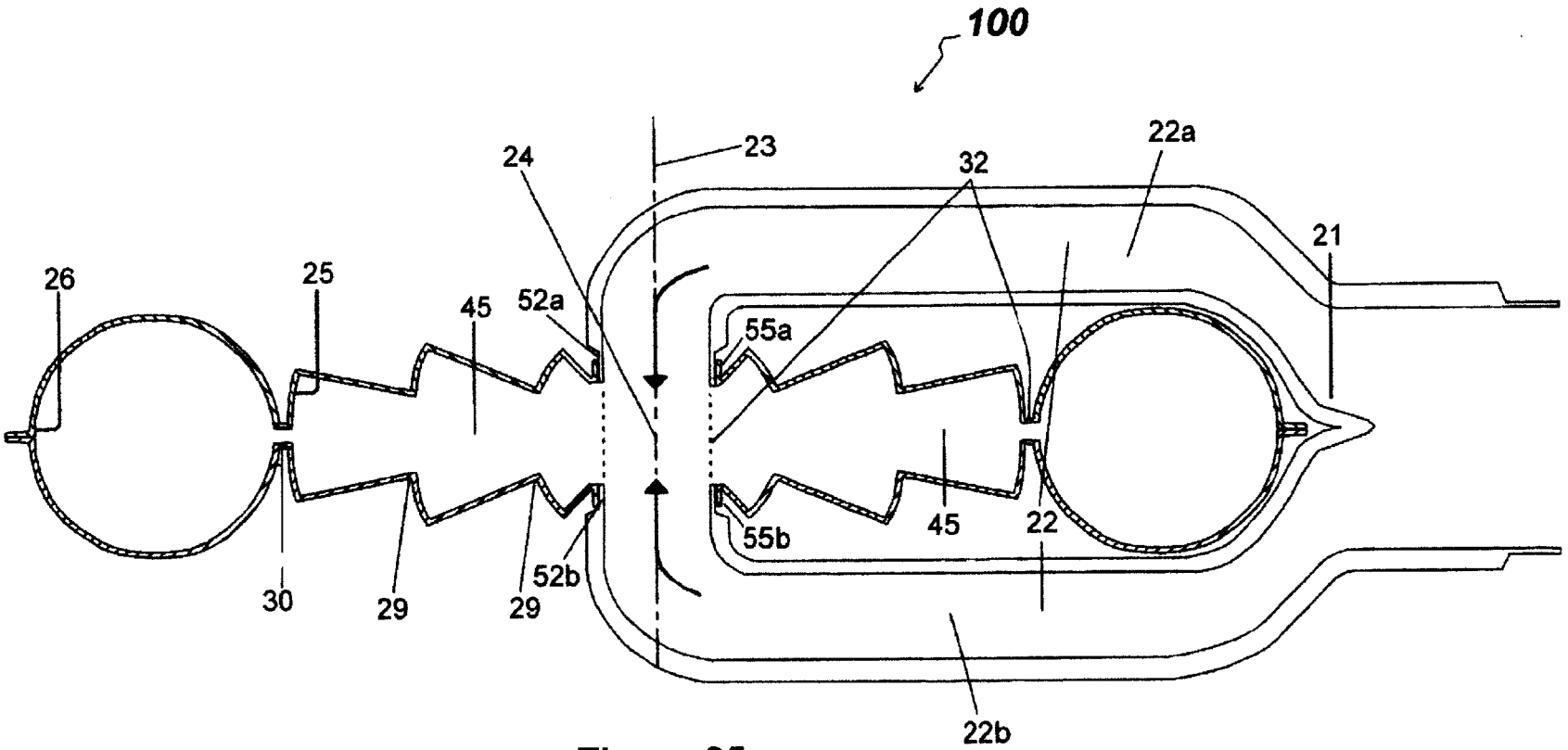
FIG. 5 shows a cross-sectional view of the first exemplary muffler as depicted in FIG. 2.

While the invention is susceptible to various modifications and alternative forms, exemplary embodiments thereof have been shown by way of example in the drawings and will herein be described in detail. It should be understood, however, that there is no intent to limit the invention to the particular forms disclosed. On the contrary, the intention is to cover all modifications, equivalents, and alternatives falling within the spirit and scope of the invention as defined by the appended claims.

A first exemplary muffler 100 which incorporates various features of the present invention therein is shown in FIGS. 1–5. As depicted, the first exemplary muffler includes a dividing inlet 21, a sound cancellation chamber 45, and an outlet collector ring 27. The dividing inlet 21 includes a first inlet channel 22*a* and a second inlet channel 22*b* that are equal in length and cross-sectional inner area. In operation, the dividing inlet 21 respectively splits, via the first inlet channel 22*a* and the second inlet channel 22*b*, an exhaust stream entering the dividing inlet 21 into a first exhaust stream and a second exhaust stream that are essentially equal in exhaust gas volume.

The first inlet channel 22*a* includes a first outlet aperture 52*a* through which the first inlet channel 22*a* directs the first exhaust stream into the sound cancellation chamber 45 via a first inlet aperture 55*a* of the sound cancellation chamber 45. Similarly, the second inlet channel 22*b* includes a second outlet aperture 52*b* through which the second inlet channel 22*b* directs the second exhaust stream into the sound cancellation chamber 45 via a second inlet aperture 55*b* of the sound cancellation chamber 45. The first outlet aperture 52*a* of the first inlet channel 22*a* and the second outlet aperture 52*b* of the second inlet channel 22*b* are arranged such that the first inlet channel 22*a* and the second inlet channel 22*b* respectively direct the first exhaust stream and the second exhaust stream toward each other along a common counter-flow centerline 23.

Due to the above arrangement of the first inlet channel 22*a* and the second inlet channel 22*b*, the first exhaust stream and the second exhaust stream during operation essentially meet each other at a noise cancellation point 24 on the common counter-flow centerline 23. As a result, the noise present in the first exhaust stream tends to interfere with the noise present in the second exhaust stream which causes the overall noise level of the two exhaust stream to be attenuated.

The sound cancellation chamber 45 includes a first major surface 60*a*, a second major surface 60*b* and a reflector wall 62. The first major surface 60*a* and the second major surface 60*b* are essentially parallel to one another and are separated at the periphery by the reflector wall 62, thus defining the sound cancellation chamber 45. Moreover, as depicted in FIGS. 1–5, each of the first major surface 60*a* and the second major surface 60*b* include several reflector rings 25 having a somewhat parabolic-shape that reflects sound towards the noise cancellation point 24.

The reflector wall 62 similarly has a somewhat parabolic-shape that reflects sound towards the noise cancellation point 24. The reflector wall 62 also includes a flow control aperture ring 30 which couples the reflector wall 62 to the outlet collector ring 27. The flow control aperture ring 30 essentially smooths and apportions exhaust flow from the sound cancellation chamber 45 to the outlet collector ring 27. Due to the ring-like nature of the flow control aperture ring 30, the flow control aperture ring 30 may be relatively narrow without creating significant resistance to the flow of exhaust. For example, a flow control aperture ring 30 having a sixteen inch (16") diameter and a one-sixteenth inch (1/16") gap has a flow area that is approximately equivalent to the flow area of a dividing inlet 21 with a two inch (2") diameter.

As a result of the above configuration of the sound cancellation chamber 45, exhaust from the first inlet channel 22*a* and the second inlet channel 22*b* spreads radially in an essentially 360 degree circle and the sound waves in the exhaust reflect off the somewhat parabolic-shaped ring reflectors 25 and the somewhat parabolic-shaped reflector wall 62 towards the noise cancellation point 24. The reflected sound waves then interfere with one another thus further attenuating the overall noise level of the exhaust.

The outlet collector ring 27 of the fist exemplary muffler comprises an essentially toroidal shape having a closed end 31, an outlet aperture 66, and an outer reflecting wall 26 that tends to reflect sound waves of the exhaust toward the noise cancellation point 24. The outlet collector ring 27 essentially receives sound waves and exhaust from the sound cancellation chamber 45 and channels the received sound waves and exhaust circumferentially about the sound cancellation chamber 45 toward the outlet aperture 66. More specifically, the outlet collector ring 27 essentially causes exhaust flowing from the sound cancellation chamber 45 through the flow control aperture ring 30 to make a right angle turn and head towards an outlet tube 28 coupled to the outlet aperture 66 of the outlet collector ring 27. In particular, the outlet collector ring 27 causes a portion of the exhaust and associated sound waves to take a direct route to the outlet aperture 66 as indicated by the exhaust flow arrow A of FIG. 4. Accordingly, a portion of the exhaust and associated sound waves travel only a short distance circumferentially about the sound cancellation chamber 45. Conversely, the outlet collector ring 27 causes exhaust and associated sound waves adjacent to the above-identified exhaust to travel circumferentially about the entire length of the outlet collector ring 27 before exiting the outlet collector ring 27 at the outlet aperture 66 as indicated by arrow Z of FIG. 4.

Since noise pulses coming into the muffler exit the sound cancellation chamber 45 in essentially a 360 degree pattern, the noise pulses become wide-spread and of weaker intensity. As the noise pulses reach the outlet collector ring 27, each noise pulse occupies the length of the outlet collector ring 27, and acquires a much longer time span as the noise pulse exits from the muffler than the noise pulse occupied when the noise pulse entered the muffler. The time warp action of the outlet collector ring 27 (i.e. the stretching of the noise pulses beyond their original time period), reduces the amplitude of the noise pulses as the energy formerly confined to a short time period is spread over a much longer time period. Accordingly, the time warp action of the outlet collector ring 27 attenuates the noise level of the exhaust even further.

Figure 6:
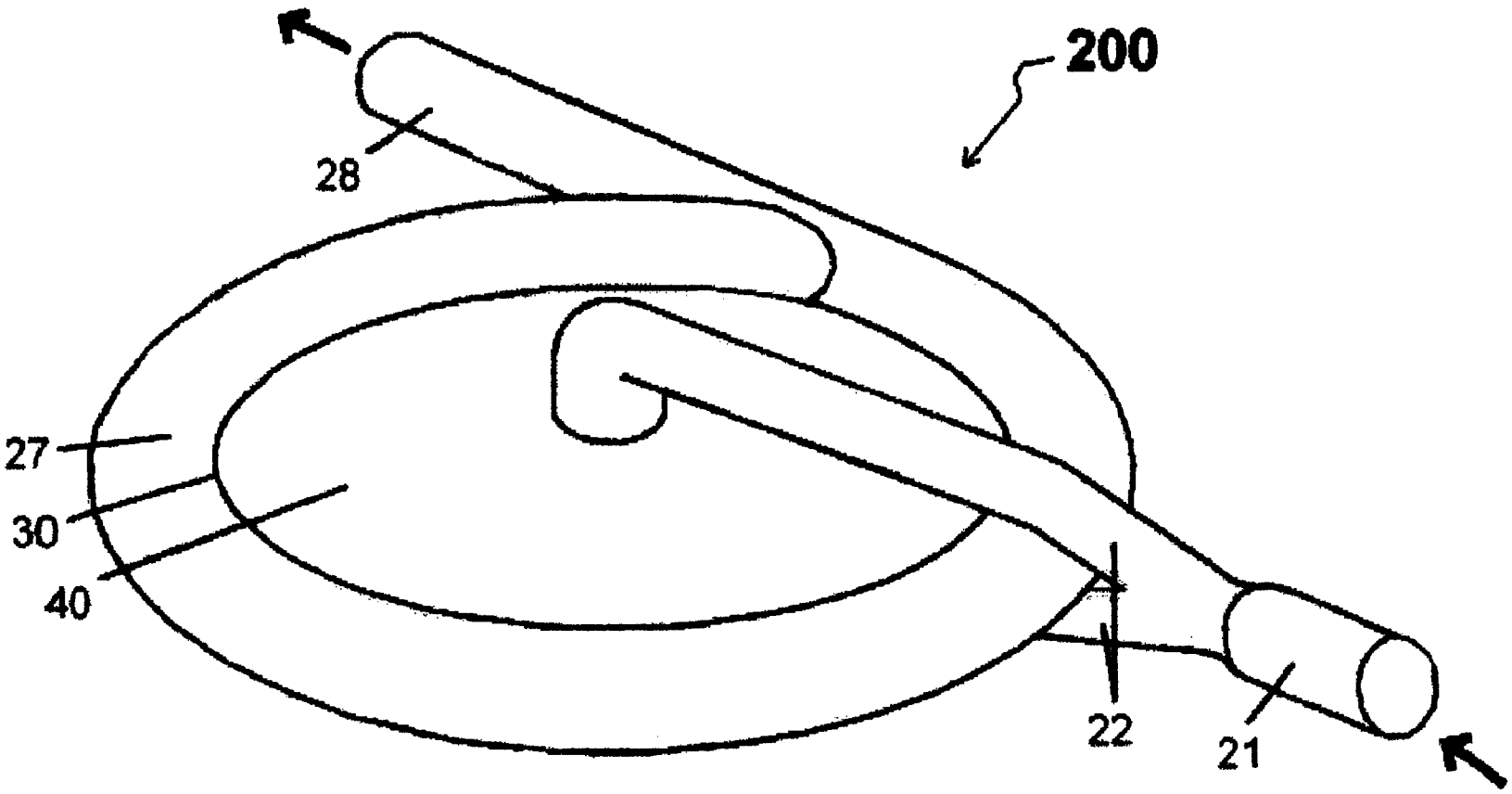
FIG. 6 shows a perspective view of a second exemplary muffler which incorporates various features of the present invention therein.
Figure 7:
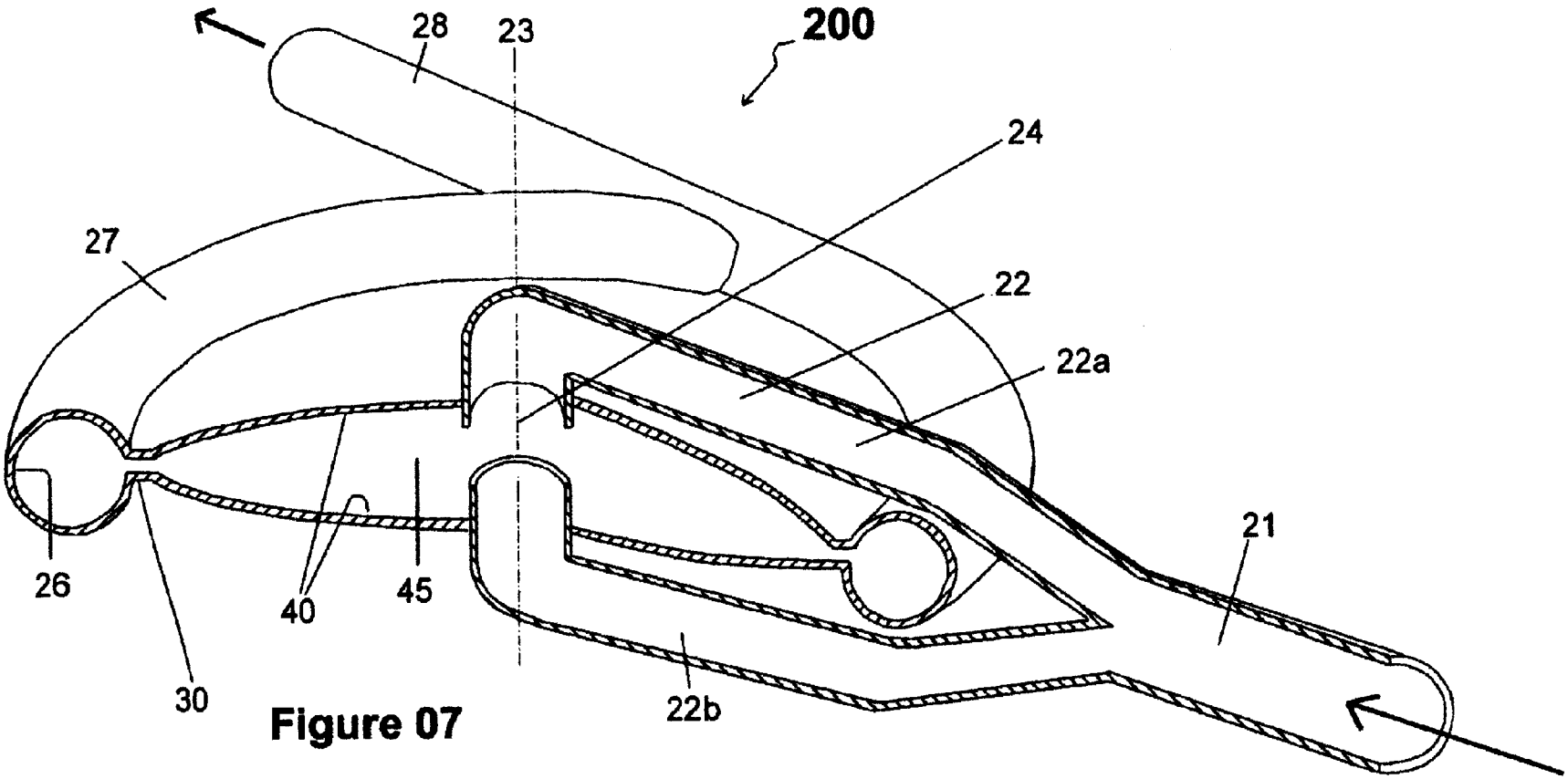
FIG. 7 shows a perspective cut-away view of the second exemplary muffler as depicted in FIG. 6.

FIGS. 6 and 7 illustrate a second exemplary muffler 200 that incorporates various features of the present invention. The second exemplary muffler 200 operates in a manner quite similar to the first exemplary muffler 100 of FIGS. 1–5. The main difference between the second exemplary muffler 200 and the first exemplary muffler 100 is that the first major surface 40*a* and the second major surface 40*b* of the sound cancellation chamber 45 do not include several ring reflectors 25 which direct sound waves toward a noise cancellation point 24. Instead, the first major surface 40*a* and the second major surface 40*b* of the sound cancellation chamber 45 have a parabolic dish shape without any ring reflectors 25. More specifically, the first major surface 40*a* and the second major surface 40*b* are shaped to reflect sound waves toward the noise cancellation point 24.

Figure 8:
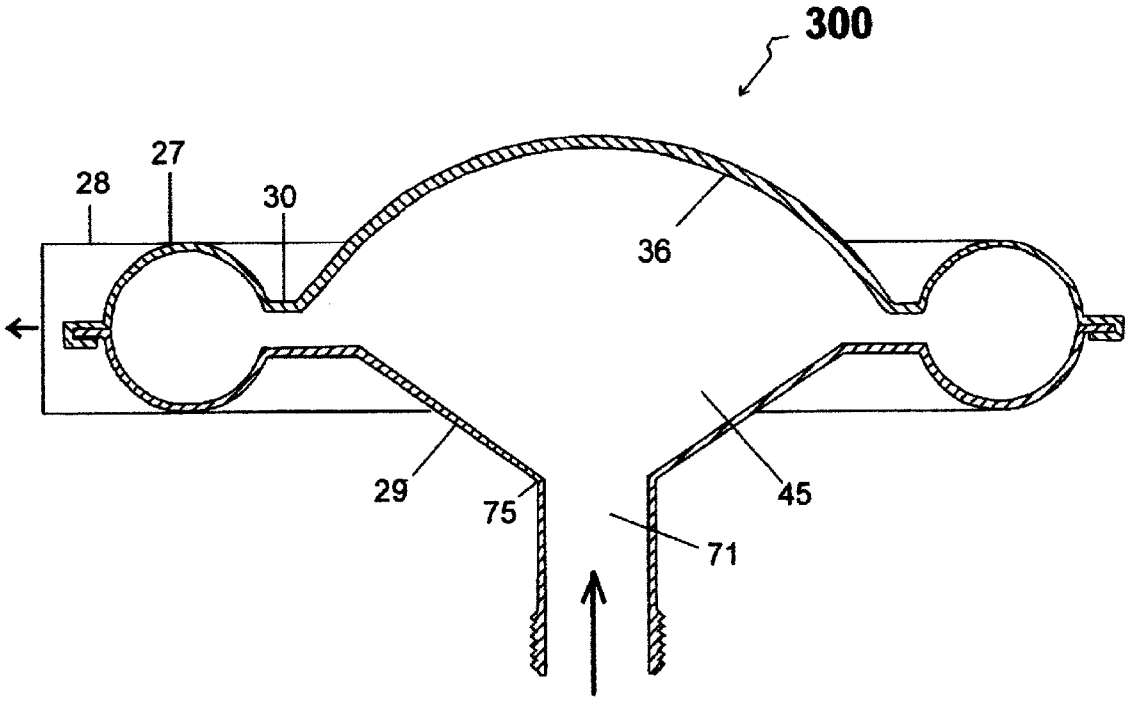
FIG. 8 shows a cross-sectional view of a third exemplary muffler which incorporates various features of the present invention therein.

FIG. 8 shows a third exemplary muffler 300 that incorporates various features of the present invention therein. The third exemplary muffler includes a single inlet 71 that directs a single exhaust stream through an inlet aperture 75 of the sound cancellation chamber 45. More specifically, the inlet side of the sound cancellation chamber includes a first major surface 29 having funnel shape, and a second major surface 36 having a parabolic shape configured to reflect sound waves toward the inlet aperture 75 of the sound cancellation chamber 45.

Figure 9:
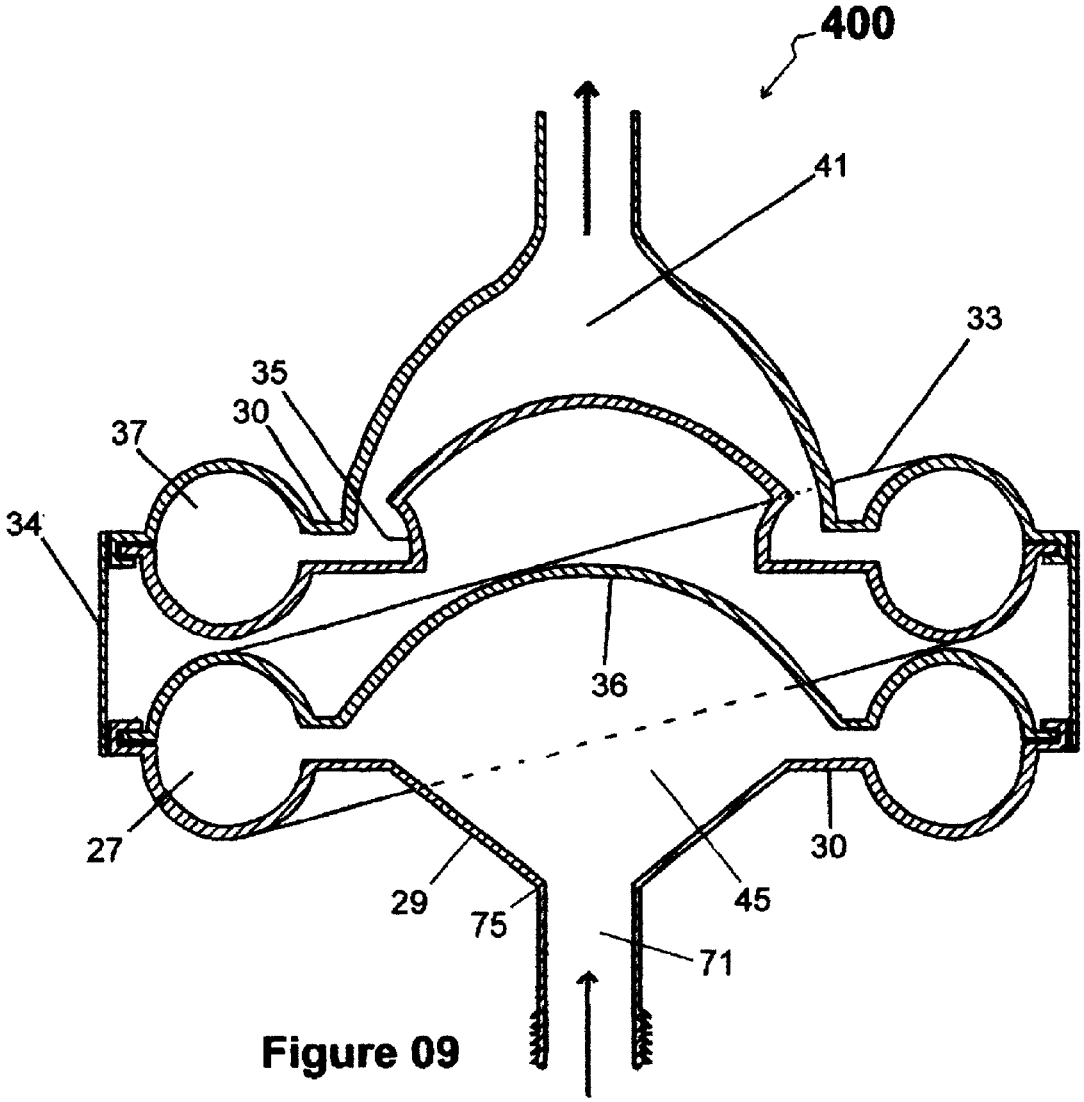
FIG. 9 shows a cross-sectional view of a fourth exemplary, dual sound cancellation chamber muffler which incorporates various features of the present invention therein.
Figure 10:
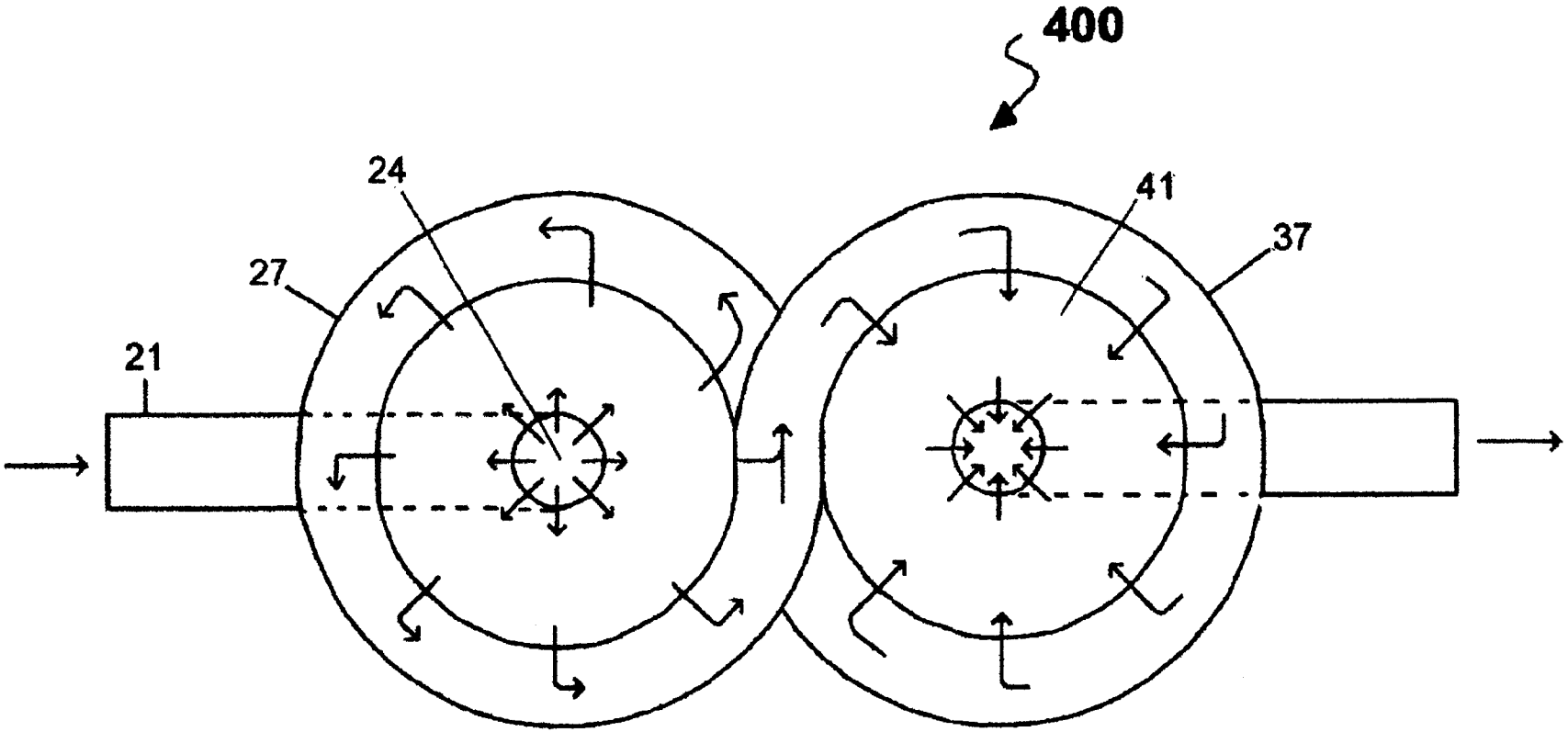
FIG. 10 shows a flow diagram for the fourth exemplary muffler depicted in FIG. 9.

Shown in FIGS. 9–10 is a fourth exemplary muffler 400 which incorporates various features of the present invention therein. The fourth exemplary muffler essentially comprises the single inlet muffler 300 depicted in FIG. 8 with a second stage attached by a strengthening shell 34. A connecting tube 33 couples the outlet ring collector 27 of the first stage to a ring-shaped dispersion chamber 37 of the second stage. The ring-shaped dispersion chamber 37 essentially disperses exhaust received from the first stage via the connecting tube 33 into an outlet collection chamber 41 of the second stage. As depicted in FIG. 9, the outlet collection chamber 41 of the second stage includes an outward reflecting ring 35 that tends to reflect sound waves toward the ring-shaped dispersion chamber 37, thus causing the reflected sound waves to interfere with other sound waves and attenuate the overall noise level of the exhaust.

Figure 11:
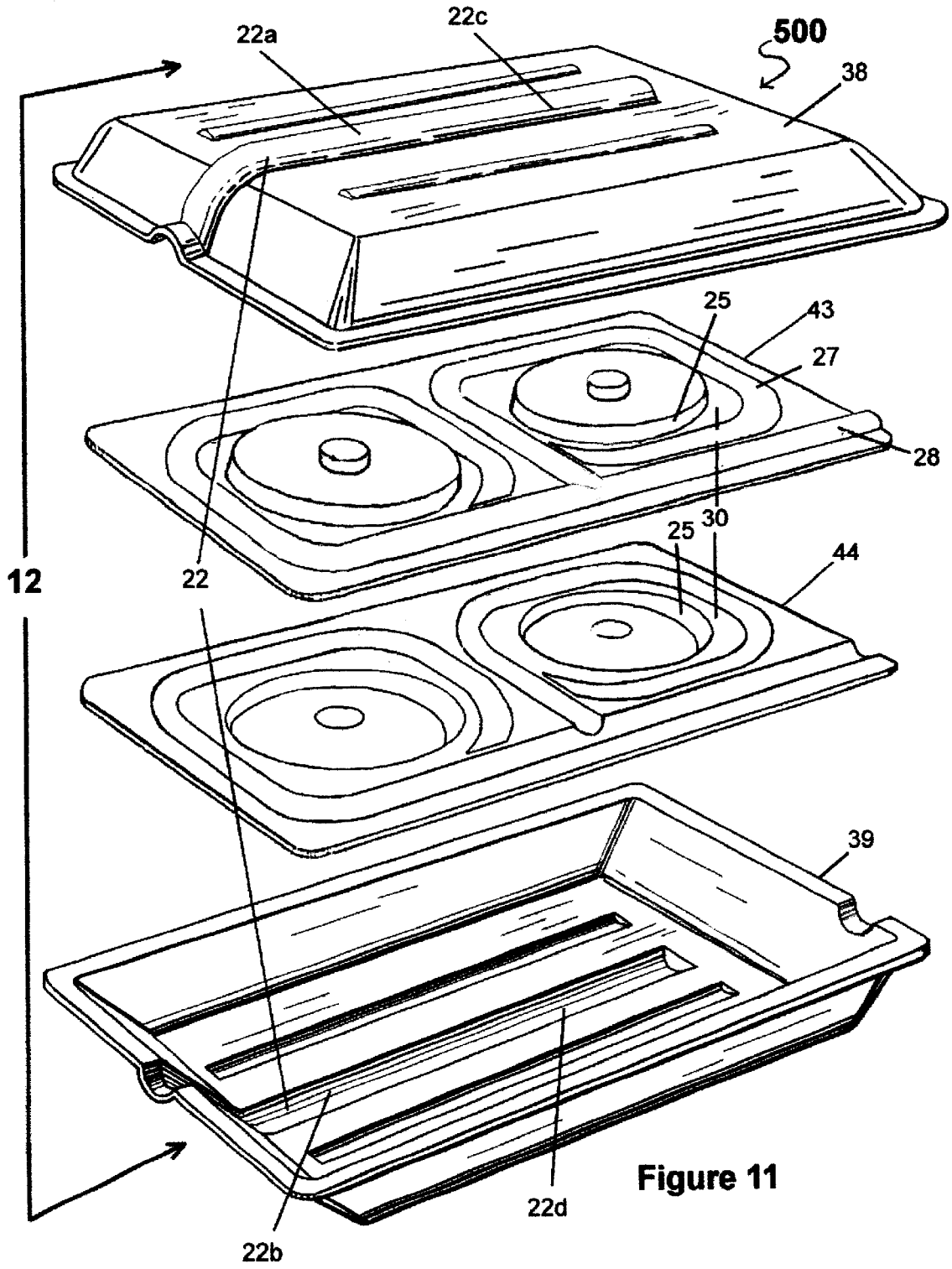
FIG. 11 shows an exploded view of a fifth exemplary stamp-formed, dual sound cancellation chamber muffler which incorporate various features of the present invention therein.
Figure 12:
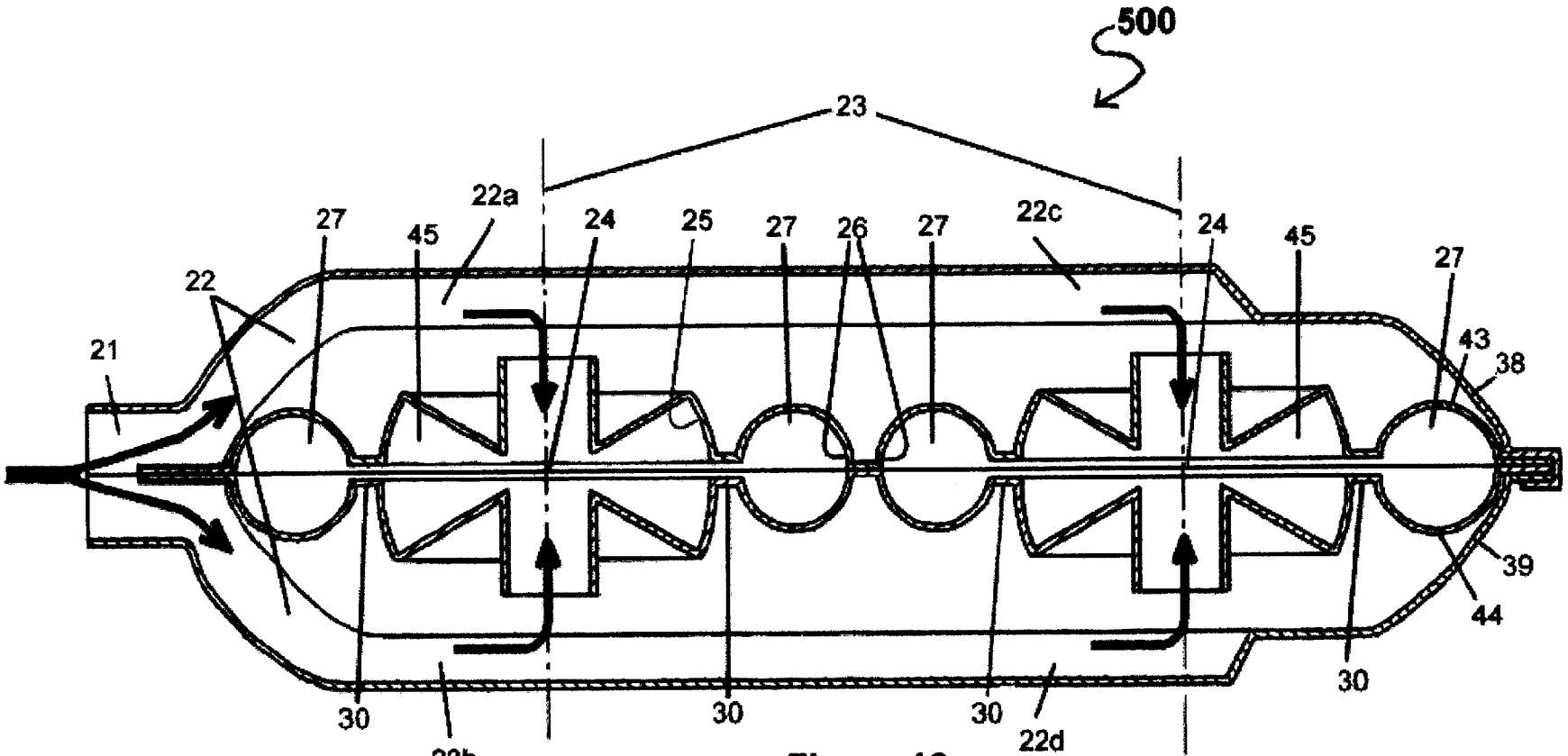
FIG. 12 shows a cross-sectional view of the fifth exemplary muffler depicted in FIG. 11.

A fifth exemplary muffler 500 is depicted in FIGS. 11 and 12. As depicted, the fifth exemplary muffler is a stamp-formed muffler having two or more sound deadening units similar in function to the first exemplary muffler of FIGS. 1–5. Moreover, the fifth exemplary muffler employs a parallel flow pattern which provides greater flow capacity than would be experienced with a series arrangement. A series flow pattern, however, provides greater noise reduction than a parallel flow pattern. Embodiments of either flow pattern could be conformed to the space of traditional mufflers found most commonly in the automotive field. Moreover, one skilled in the art could easily modify the parallel flow pattern shown in FIGS. 11 and 12 to obtain a muffler having two sound deadening units and a series flow pattern.

As depicted in FIGS. 11–12, the fifth exemplary muffler 500 includes an upper inner plate 43 and the lower inner plate 44 which form all parts of the fifth exemplary muffler 500 except the dividing inlet 21 and the inlet channels 22*a*, 22*b*, 22*c*, and 22*d*. Moreover, the fifth exemplary muffler 500 includes an upper shell 38 and a lower shell 39 which form the dividing inlet 21, the first inlet channel 22*a*, the second inlet channel 22*b*, the third inlet channel 22*c*, and fourth inlet channel 22*d* when the upper shell 38 and the lower shell 39 is either clamped or welded to the upper inner plate 43 and the lower inner place 44 via sealing surfaces 42 of the upper shell 38, the lower shell 39, the upper inner plate 43, and the lower inner plate 44.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A muffler for reducing noise in an exhaust stream, comprising:

a first sound cancellation chamber comprising a first major surface with a first intake aperture and a first peripheral edge, and a second major surface with a second intake aperture and a second peripheral edge, a first dividing inlet operable to receive said exhaust stream and split said exhaust stream into a first exhaust stream and a second exhaust stream, said first dividing inlet comprising a first inlet channel operable to direct said first exhaust stream into said first intake aperture on a first common counter-flow centerline in a first flow direction, and a second inlet channel operable to direct said second exhaust stream into said second intake aperture on said first common counter-flow centerline in a second flow direction that is opposite said first flow direction such that said second exhaust stream and said first exhaust stream meet substantially at a first noise cancellation point on said first common counter-flow centerline that is located between said first major surface and said second major surface of said first sound cancellation chamber; and an outlet collector ring coupled to said first peripheral edge and said second peripheral edge of said first sound cancellation chamber such that said outlet collector ring is operable to receive and expel exhaust from said first sound cancellation chamber.

2. The muffler of claim 1, wherein:

said first major surface comprises a first plurality of reflector walls operable to direct sound toward said first noise cancellation point.

3. The muffler of claim 1, wherein:

said first major surface comprises a first plurality of reflector walls operable to direct sound toward said first noise cancellation point, and said second major surface comprises a second plurality of reflector walls operable to direct sound toward said first noise cancellation point.

4. The muffler of claim 1, wherein:

said first outlet collector ring is operable to substantially direct said exhaust received from said first sound cancellation chamber circumferentially about said first sound cancellation chamber toward a first outlet aperture of said first outlet collector ring.

5. The muffler of claim 1, wherein said first outlet collector ring is operable to expel said exhaust received from said first sound cancellation chamber through a first outlet aperture of said first outlet collector ring, said muffler further comprising:

a second sound cancellation chamber comprising a third major surface with a third intake aperture and a third peripheral edge, and a fourth major surface with a fourth intake aperture and a fourth peripheral edge, a second dividing inlet operable to receive said exhaust from said first outlet aperture of said first outlet collector ring stream and split said exhaust from said first outlet aperture into a third exhaust stream and a fourth exhaust stream, said second dividing inlet comprising a third inlet channel operable to direct said third exhaust stream into said third intake aperture on a second common counter-flow centerline in a third flow direction, and a fourth inlet channel operable to direct said fourth exhaust stream into said fourth intake aperture on said second common counter-flow centerline in a fourth flow direction that is opposite said third flow direction such that said fourth exhaust stream and said third exhaust stream meet substantially at a second noise cancellation point on said second common counter-flow centerline that is located between said third major surface and said fourth major surface of said second sound cancellation chamber; and a second outlet collector ring coupled to said third peripheral edge and said fourth peripheral edge of said second sound cancellation chamber such that said second outlet collector ring is operable to receive and expel exhaust from said second sound cancellation chamber.

6. The muffler of claim 1, further comprising:

a second sound cancellation chamber comprising a third major surface with a third intake aperture and a third peripheral edge, and a fourth major surface with a fourth intake aperture and a fourth peripheral edge, and a second outlet collector ring coupled to said third peripheral edge and said fourth peripheral edge of said second sound cancellation chamber such that said second outlet collector ring is operable to receive and expel exhaust from said second sound cancellation chamber, wherein said first dividing inlet being further operable to split said exhaust stream into a third exhaust stream and a fourth exhaust stream, said first dividing inlet further comprising a third inlet channel operable to direct said third exhaust stream into said third intake aperture on a second common counter-flow centerline in a third flow direction, and a fourth inlet channel operable to direct said fourth exhaust stream into said fourth intake aperture on said second common counter-flow centerline in a fourth flow direction that is opposite said third flow direction such that said fourth exhaust stream and said third exhaust stream meet substantially at a second noise cancellation center point on said second common counter-flow centerline that is located between said third major surface and said fourth major surface of said second sound cancellation chamber.

7. The muffler of claim 1, wherein said first sound cancellation chamber comprises:

a reflector wall coupled between said first major surface and said second major surface that reflects sound towards said first noise cancellation point, said reflector wall comprising a flow control aperture ring operable to apportion flow of said exhaust from said first sound cancellation chamber into said first outlet collector ring.

8. A muffler for reducing noise in an exhaust stream, comprising:

a first sound cancellation chamber comprising a first major surface with a first intake aperture, a first peripheral edge, and a first plurality of reflector walls operable to direct sound toward said first intake aperture, and a second major surface with a second intake aperture, a second peripheral edge, and a second plurality of reflector walls operable to direct sound toward said second intake aperture;

a first dividing inlet operable to receive said exhaust stream and split said exhaust stream into a first exhaust stream and a second exhaust stream, said first dividing inlet comprising a first inlet channel operable to direct said first exhaust stream into said first intake aperture of said first sound cancellation chamber, and a second inlet channel operable to direct said second exhaust stream into said second intake aperture of said first sound cancellation chamber; and a first outlet collector ring coupled to said first peripheral edge and said second peripheral edge of said first sound cancellation chamber such that said first outlet collector ring is operable to receive and expel exhaust from said first sound cancellation chamber.

9. The muffler of claim 8, wherein:

said first outlet collector ring is operable to substantially direct said exhaust received from said first sound cancellation chamber circumferentially about said first sound cancellation chamber toward a first outlet aperture of said first outlet collector ring.

10. The muffler of claim 8, wherein said first outlet collector ring is operable to expel said exhaust received from said first sound cancellation chamber through a first outlet aperture of said first outlet collector ring, said muffler further comprising:

a second sound cancellation chamber comprising a third major surface with a third intake aperture and a third peripheral edge, and a fourth major surface with a fourth intake aperture and a fourth peripheral edge, a second dividing inlet operable to receive said exhaust from said first outlet aperture of said first outlet collector ring stream and split said exhaust from said first outlet aperture into a third exhaust stream and a fourth exhaust stream, said second dividing inlet comprising a third inlet channel operable to direct said third exhaust stream into said third intake aperture, and a fourth inlet channel operable to direct said fourth exhaust stream into said fourth intake aperture; and a second outlet collector ring coupled to said third peripheral edge and said fourth peripheral edge of said second sound cancellation chamber such that said second outlet collector ring is operable to receive and expel exhaust from said second sound cancellation chamber.

11. The muffler of claim 8, further comprising:

a second sound cancellation chamber comprising a third major surface with a third intake aperture and a third peripheral edge, and a fourth major surface with a fourth intake aperture and a fourth peripheral edge, and a second outlet collector ring coupled to said third peripheral edge and said fourth peripheral edge of said second sound cancellation chamber such that said second outlet collector ring is operable to receive and expel exhaust from said second sound cancellation chamber, wherein said first dividing inlet being further operable to split said exhaust stream into a third exhaust stream and a fourth exhaust stream, said first dividing inlet further comprising a third inlet channel operable to direct said third exhaust stream into said third intake aperture, and a fourth inlet channel operable to direct said fourth exhaust stream into said fourth intake aperture.

12. A muffler for reducing noise in an exhaust stream, comprising:

a first sound cancellation chamber comprising a first major circular surface with a first central intake aperture and a first peripheral edge,and a second major circular surface with a second central intake aperture and a second peripheral edge, said second major circular surface arranged substantially parallel with said first major circular surface, said first major circular surface and said second major circular surface operable to spread a first exhaust stream received via said first central intake aperture and a second exhaust stream received via said second central intake aperture radially outward toward said first peripheral edge and said second peripheral edge;

a first dividing inlet operable to receive said exhaust stream and split said exhaust stream into said first exhaust stream and said second exhaust stream, said first dividing inlet comprising a first inlet channel operable to direct said first exhaust stream into said first central intake aperture of said first sound cancellation chamber, and a second inlet channel operable to direct said second exhaust stream into said second central intake aperture of said second cancellation chamber; and a first outlet collector ring having a first outlet aperture and coupled to said first peripheral edge and said second peripheral edge of said first sound cancellation chamber, said first outlet collector ring operable to receive exhaust from said first sound cancellation chamber and substantially direct said exhaust circumferentially about said first sound cancellation chamber toward said first outlet aperture.

13. The muffler of claim 12, wherein:

said first major circular surface of said first sound cancellation chamber comprises a first plurality of reflector walls operable to direct sound toward said first noise cancellation point.

14. The muffler of claim 12, further comprising:

a second sound cancellation chamber comprising a third major surface with a third intake aperture and a third peripheral edge, and a fourth major surface with a fourth intake aperture and a fourth peripheral edge, a second dividing inlet operable to receive said exhaust from said first outlet aperture of said first outlet collector ring stream and split said exhaust from said first outlet aperture into a third exhaust stream and a fourth exhaust stream, said second dividing inlet comprising a third inlet channel operable to direct said third exhaust stream into said third intake aperture, and a fourth inlet channel operable to direct said fourth exhaust stream into said fourth intake aperture; and a second outlet collector ring having a second outlet aperture and coupled to said third peripheral edge and said fourth peripheral edge of said second sound cancellation chamber, said second outlet collector ring operable to receive exhaust from said second sound cancellation chamber and substantially direct said exhaust circumferentially about said second sound cancellation chamber toward said second outlet aperture.

15. The muffler of claim 12, further comprising:

a second sound cancellation chamber comprising a third major surface with a third intake aperture and a third peripheral edge, and a fourth major surface with a fourth intake aperture and a fourth peripheral edge, and a second outlet collector ring having a second outlet aperture and coupled to said third peripheral edge and said fourth peripheral edge of said second sound cancellation chamber, said second outlet collector ring operable to receive exhaust from said second sound cancellation chamber and substantially direct said exhaust circumferentially about said second sound cancellation chamber toward said second outlet aperture, wherein said first dividing inlet is further operable to split said exhaust stream into a third exhaust stream and a fourth exhaust stream, said first dividing inlet further comprising a third inlet channel operable to direct said third exhaust stream into said third intake aperture, and a fourth inlet channel operable to direct said fourth exhaust stream into said fourth intake aperture.

16. A muffler for reducing noise in an exhaust stream, comprising:

a first sound cancellation chamber comprising a first major surface with a first intake aperture and a first peripheral edge, a second major surface with a second peripheral edge, said second major surface arranged opposite said first intake aperture and shaped to reflect sound received from said first intake aperture toward said first intake aperture, and a first reflector wall coupled between said first major surface and said second major surface that reflects sound towards said first intake aperture;

a first inlet operable to receive said exhaust stream and direct said exhaust stream into said first intake aperture of said first sound cancellation chamber; and a first outlet collector ring coupled to said first peripheral edge and said second peripheral edge of said first sound cancellation chamber such that said first outlet collector ring is operable to receive and expel exhaust from said first sound cancellation chamber, wherein said first reflector wall of said first sound cancellation chamber comprises a flow control aperture ring operable to apportion flow of said exhaust from said first sound cancellation chamber into said first outlet collector ring.

17. The muffler of claim 16, wherein:

said first major surface of said first sound cancellation chamber comprises a first plurality of reflector walls operable to direct sound toward said first intake aperture.

18. The muffler of claim 16, wherein:

said first outlet collector ring is operable to substantially direct said exhaust received from said first sound cancellation chamber circumferentially about said first sound cancellation chamber toward a first outlet aperture of said first outlet collector ring.

19. The muffler of claim 16, wherein said first outlet collector ring is operable to expel said exhaust received from said first sound cancellation chamber through a first outlet aperture of said first outlet collector ring, said muffler further comprising:

a second sound cancellation chamber comprising a third major surface with a second intake aperture and a third peripheral edge, a fourth major surface with a fourth peripheral edge, said fourth major surface arranged opposite said second intake aperture and shaped to reflect sound received from said second intake aperture toward said second intake aperture, and a second reflector wall coupled between said third major surface and said fourth major surface that reflects sound towards said second intake aperture;

a second inlet operable to receive said exhaust from said first outlet aperture of said first outlet collector ring and direct said exhaust into said second intake aperture of said second sound cancellation chamber; and a second outlet collector ring coupled to said third peripheral edge and said fourth peripheral edge of said second sound cancellation chamber such that said second outlet collector ring is operable to receive and expel exhaust from said second sound cancellation chamber, wherein said second reflector wall of said first sound cancellation chamber comprises a second flow control aperture ring operable to apportion flow of said exhaust from said second sound cancellation chamber into said second outlet collector ring.

20. The muffler of claim 16, wherein said first outlet collector ring is operable to expel said exhaust received from said first sound cancellation chamber through a first outlet aperture of said first outlet collector ring, said muffler further comprising:

a ringed shaped dispersion chamber coupled to said first outlet aperture of said first outlet collector ring;

an outlet collection chamber coupled to said ringed shaped dispersion chamber and operable to receive exhaust from said ringed shaped dispersion chamber and expel said exhaust received from said ringed shaped dispersion chamber through a second outlet aperture of said outlet collection chamber, said outlet collection chamber comprising a second reflector wall that directs sound toward said ringed shaped dispersion chamber.

21. A method of reducing noise in an exhaust stream, comprising the steps of:

(a) splitting said exhaust stream into a first exhaust stream and a second exhaust stream that are substantially equal;

(b) directing said first exhaust stream into a sound cancellation chamber on a common counter-flow centerline in a first flow direction;

(c) directing said second exhaust stream into said sound cancellation chamber on said common counter-flow centerline in a second flow direction that is opposite to said first flow direction such that said second exhaust stream meets said first exhaust stream at a noise cancellation center point on said common-flow centerline inside said first sound cancellation chamber;

(d) spreading said first exhaust stream and said sound exhaust stream radially toward a periphery of said second cancellation chamber;

(e) collecting said exhaust from said periphery of said sound cancellation chamber in an outlet collector ring disposed generally radially outwardly of the first sound cancellation chamber; and (f) expelling exhaust from said outer collector ring.

22. The method of claim 21, further comprising the step of:

reflecting sound in said sound cancellation chamber toward said noise cancellation center point.

23. A method of reducing noise in an exhaust stream, comprising the steps of:

(a) splitting said exhaust stream into a first exhaust stream and a second exhaust stream that are substantially equal;

(b) directing said first exhaust stream into a sound cancellation chamber on a common counter-flow centerline in a second flow direction that is opposite to said first flow direction such that said second exhaust stream meets said first exhaust stream at a noise cancellation center point on said common-flow centerline inside said sound cancellation chamber;

(d) spreading said first exhaust stream and said second exhaust stream radially toward a periphery of said sound cancellation chamber; and (e) collecting and expelling exhaust from said sound cancellation chamber by:

collecting said exhaust from said periphery of said sound cancellation chamber in an outlet collector ring, and directing said exhaust substantially circumferentially about said sound cancellation chamber toward an outlet aperture of said outlet collector ring.

24. A method of reducing noise in an exhaust stream, comprising the steps of:

(a) splitting said exhaust stream into a first exhaust stream and a second exhaust stream that are substantially equal;

(b) directing said first exhaust stream into a sound cancellation chamber on a common counter-flow centerline in a first flow direction;

(c) directing said second exhaust stream into said sound cancellation chamber on said common counter-flow centerline in a second flow direction that is opposite to said first flow direction such that said second exhaust stream meets said first exhaust stream at a noise cancellation center point on said common-flow centerline inside said sound cancellation chamber;

(d) reflecting sound in said sound cancellation chamber toward said noise cancellation center point, (e) spreading said first exhaust stream and said second exhaust stream radially toward a periphery of said first sound cancellation chamber, (f) collecting said exhaust from said periphery of said first sound cancellation chamber in an outlet collector ring, and (g) directing said exhaust substantially circumferentially about said sound cancellation chamber toward an outlet aperture of said outlet collector ring.

25. A method of reducing noise in an exhaust stream, comprising the steps of:

directing said exhaust stream into an inlet aperture of and into a sound cancellation chamber on a generally axial flowline in a first flow direction;

reflecting sound in said sound cancellation chamber off a parabolic surface toward a focal point adjacent to said inlet aperture of said sound cancellation chamber;

spreading said exhaust stream radially toward a periphery of said sound cancellation chamber;

collecting exhaust from said periphery of said sound cancellation chamber in an outlet collector ring; and directing said exhaust collected from said periphery of said sound cancellation chamber substantially circumferentially about said sound cancellation chamber toward an outlet aperture of said outlet collector ring.

26. A method of reducing noise in an exhaust stream, comprising the steps of:

(a) splitting said exhaust stream into a first exhaust stream and a second exhaust stream that are substantially equal;

(b) directing said first exhaust stream into a sound cancellation chamber on a common counter-flow centerline in a first flow direction;

(c) directing said second exhaust stream into said sound cancellation chamber on said common counter-flow centerline in a second flow direction that is opposite to said first flow direction such that said second exhaust stream meets said first exhaust stream at a noise cancellation center point on said common-flow centerline inside said first sound cancellation chamber;

(d) collecting said exhaust from said sound cancellation chamber in an outlet collector ring disposed peripherally the first sound cancellation chamber; and (e) directing said exhaust collected in the outlet collector ring in a single, substantially circular path within the outlet ring toward an outlet aperture of said outlet collector ring.

* * * * *